United States Patent [19]

Kindness

[11] Patent Number: 4,713,849

[45] Date of Patent: Dec. 22, 1987

[54] POOL LINER RETAINER WITH CLOSURE CLIP

[75] Inventor: William Kindness, Toronto, Canada

[73] Assignee: Kafko Manufacturing Limited, Mississagua, Canada

[21] Appl. No.: 20,228

[22] Filed: Mar. 2, 1987

Related U.S. Application Data

[63] Continuation of Ser. No. 777,581, Sep. 19, 1985.

[51] Int. Cl.[4] ..... E04H 3/18

[52] U.S. Cl. ..... 4/496; 4/506

[58] Field of Search ..... 4/496, 503, 506; 52/169.7, 222, 273, 300, 586; 160/391, 395

[56] References Cited

U.S. PATENT DOCUMENTS

| | | | |
|---|---|---|---|
| 3,427,663 | 2/1969 | O'Connell et al. | 4/172 |
| 3,628,198 | 12/1971 | Katzman | 4/172.21 |
| 3,833,046 | 9/1974 | Tombu | 160/395 X |
| 3,851,848 | 12/1974 | Wiele | 160/391 X |
| 3,950,869 | 4/1976 | Samarin | 160/395 X |
| 4,064,571 | 12/1977 | Phipps | 4/506 X |
| 4,107,826 | 8/1978 | Tysdal | 160/395 X |
| 4,158,244 | 6/1979 | Stefan | 4/503 X |

FOREIGN PATENT DOCUMENTS

| | | | |
|---|---|---|---|
| 1167604 | 5/1984 | Canada | 52/169.7 |
| 1123134 | 8/1968 | United Kingdom . | |
| 1395602 | 5/1975 | United Kingdom . | |

*Primary Examiner*—Charles E. Phillips

*Attorney, Agent, or Firm*—Shapiro and Shapiro

[57] ABSTRACT

A pool liner retainer for holding or retaining the top peripheral edge portion or liner bead of a watertight pool liner. The retainer includes an elongate retaining element defining a holding channel adapted to accommodate the liner bead. This channel defines a longitudinal outward slot for insertion of the bead into the channel. The retaining element includes a downwardly extending flange forming an upper edge of the slot. An elongate clip has a longitudinal cavity extending therealong adapted to receive the flange in a tight fitting manner. The clip partially closes the slot when the clip is mounted on the flange. After the bead has been inserted into the channel, the clip can be mounted on the flange to partially close the slot and thereby retain the liner bead. Preferably the retaining element includes an upwardly extending flange forming a bottom edge of the slot.

14 Claims, 3 Drawing Figures

POOL LINER RETAINER WITH CLOSURE CLIP

This is a continuation application of Ser. No. 777,581 filed Sept. 19, 1985, which is now abandoned.

BACKGROUND OF THE INVENTION

This invention relates to devices for retaining the top peripheral edge portion of a watertight liner such as the type used in the construction of swimming pools.

A common and well known method of constructing swimming pools comprises the erection or placement of fixed walls and a floor for the pool which are not watertight but which have sufficient structural strength to contain the water. A pool liner is required in such a pool to make it watertight. The liner is constructed from a waterproof sheet material which often consists of vinyl. The liner has a top peripheral edge portion that corresponds with or is located adjacent to the top of the structural walls of the pool. Various methods have been proposed and used to attach the top peripheral edge of the liner to the top of the pool walls in order to ensure that the liner does not slip down below the water line. Many of these methods involve the use of preformed coping members which finish and round the top peripheral edge of the pool for safety and attractive appearance. Commonly, a groove or slot is provided in this coping for receiving a thickened bead formed on the top peripheral edge portion of the liner. A longitudinal flange located adjacent to the mouth of the slot engages a corresponding flange or lip in the liner bead in order to retain the liner edge. One difficulty with such a method arises from the fact that in order to insert the liner bead into the slot, the bead and slot must be dimensioned loosely. This fact can result in the liner being pulled out of the coping slot. If this should occur, the liner normally cannot be reinserted into the coping without draining the pool.

In U.S. Pat. No. 4,158,244 issued June 19, 1979 to Timerax Holdings Ltd. the retaining element, in addition to having a holding channel for accommodating the liner bead, has a generally cylindrical hinge channel communicating with the holding channel. An elongate resilient U-shaped insert is located in the hinge channel. This insert has an outward closing element depending from the hinge channel to partially close a longitudinal outward slot defined by the two channels. A rib arrangement is provided to prevent rotation of the insert in the hinge channel. The closing element is biased towards the slot so that, after insertion of the liner bead, the insert engages a stop, partially closes the slot, and retains the liner bead.

British Pat. No. 1,395,602 also discloses a strip attachment for securing the edge of a fabric to a surface. The front face of the attachment has a rib that defines the top of a recess for receiving a rod or bead attached to the edge of the fabric. The device of the British patent includes a cover member having an upper section that is inserted between a top projecting portion of the strip attachment and the rib. A front section of the cover member extends over the recess in the strip attachment and the rod therein. The cover member of this patent is provided for appearances only and does not assist in the retention of the rod attached to the edge of the fabric.

It is an object of the present invention to provide a very simple structure for positively retaining the top peripheral edge portion of a pool liner.

It is a further object of the present invention to provide an inexpensive pool liner retainer that employs an elongate clip that is fitted onto a flange of an elongate retaining element in order to partially close a slot in the retaining element and thereby retain a liner bead in the retaining element.

SUMMARY OF THE INVENTION

According to the present invention, a pool liner retainer comprises an elongate retaining element defining a holding channel adapted to accommodate a liner bead. The holding channel defines a longitudinal outward slot for insertion of the liner bead into the holding channel. The retaining element includes a downwardly extending flange forming an upper edge of the slot. The retainer further includes an elongate clip having a longitudinal cavity extending therealong adapted to receive the flange in a tight fitting manner. The clip partially closes the slot when it is mounted on the flange. After the liner bead has been inserted into the holding channel, the clip can be mounted on the flange to partially close the slot and retain the liner bead in the channel.

Preferably the retaining element includes an upwardly extending flange forming a bottom edge of the slot. The preferred clip is generally V-shaped in cross-section, being wider at the top thereof than along a narrow bottom edge.

Further features and advantages will become apparent from the following detailed description, taken in conjunction with the accompanying drawings.

DETAILED DESCRIPTION OF PREFERRED EMBODIMENTS

Figure 1:
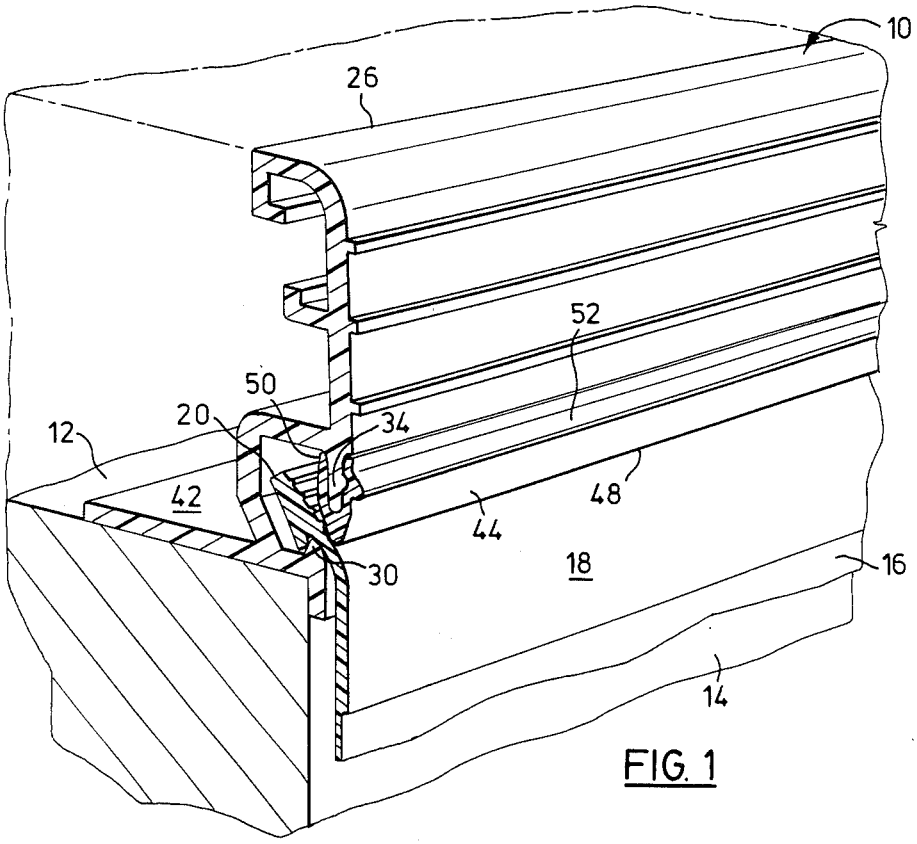
FIG. 1 is a perspective view of a pool liner retainer constructed in accordance with the invention.

A pool liner retainer 10 is shown mounted on a top peripheral edge portion 12 of a structural wall 14 of a swimming pool. The wall 14 shown in FIG. 1 is made of concrete but it will be appreciated that it could be made of other materials or it could have a different costruction if desired. A portion of a pool liner 16 is also shown in the drawings. The liner can be made of sheet vinyl material to form a water tight envelope conforming with the inside structural surfaces of the swimming pool. The liner 16 has a top peripheral edge portion 18 that includes a liner bead 20 that is formed from a much greater thickness of vinyl material. The liner bead has an upwardly extending groove 22 formed therein. This groove 22 assists in the retention of the pool liner in the retainer as explained hereinafter. The liner bead 20 is of well known constuction and does not itself form part of the present invention.

The retainer 10 includes an elongate retaining element 24 which is integrally formed as part of a coping 26. The retaining element 24 defines a holding channel 28 which is dimensioned to accommodate the liner bead 20. In the preferred embodiment shown, the holding channel 28 has a height H slightly greater than the combined height of the liner bead 20 and an upwardly extending flange 30 of the retaining element. These dimensions allow for easy insertion of the liner bead into the holding channel. The retaining element 24 defines a longitudinal outward slot 32 communicating with the holding channel 28. The liner bead 20 is inserted throguh this slot into the retaining element. It will be particularly noted that the bead 20 when installed stands up almost vertically unlike prior art arrangements where this bead extends horizontally. Because the holding channel does not extend horizontally as in the past, it is not susceptible to the same leverage forces (due to the wall 14 heaving, etc.) and therefore the liner bead is not as likely to be pulled out of the holding channel.

In addition to the aforementioned flange 30, the front of the holding channel 28 is defined by a downwardly extending flange 34 forming an upper edge of the slot 32. Preferably the flange 34 has a longitudinally extending ridge or bump 35 formed on the outside thereof and located approximately half way up the flange 34. The top of the holding channel is provided by a horizontal section 36. The section 36 is connected to a vertical section 38 which extends at a small angle to the horizontal in the lower region 40. The bottom of the coping and the bottom of the holding channel 28 are formed by an integral hoizontal plate 42.

An elongate clip 44 has a longitudinal cavity 46 extending therealong adapted to receive the flange 34 in a tight fitting manner. The clip 44 is preferably made of a resilient plastic material such as polyvinyl chloride. The preferred embodiment shown is generally V-shaped in cross-section being wider at the top thereof than along a narrow bottom edge 48. As clearly shown in FIG. 3, the height of the clip 44 is at least three-quarters the height of the holding channel 28. Also, the vertical length of the downwardly extending flange 34 equals approximately one-half the height H of the holding channel. With these dimensions, the attachment of the clip 44 to the flange will result in the slot 32 being partially closed. In fact, the slot is sufficiently closed that removal of the liner bead from the holding channel 28 is prevented. As shown, the clip 44 has a substantially straight inner leg 50 and an outer leg 52 defining the sides of the cavity 46. The outer leg 52 is bowed outwardly at 54 along a central portion thereof and has an outer ridge 55 formed thereon to permit the clip to be gripped easily by an installer's fingertips. The bent configuration of the leg 52 forms a longitudinally extending recess 57 for receiving the ridge 35 and this engagement helps to hold the clip on the flange (in addition to the tight friction fit). Preferably the ridge 35 is about the same size as the recess 57. The retaining element 24 and coping 26 are also formed of polyvinyl chloride in the preferred embodiment. These members are generally extruded and cut to standard lengths ranging from 6 to 10 feet. If the retaining element 24 is to be used at a rounded corner, a suitable rounded corner piece can be extruded or the retaining element can be bent into the desired configuration.

Figure 2:
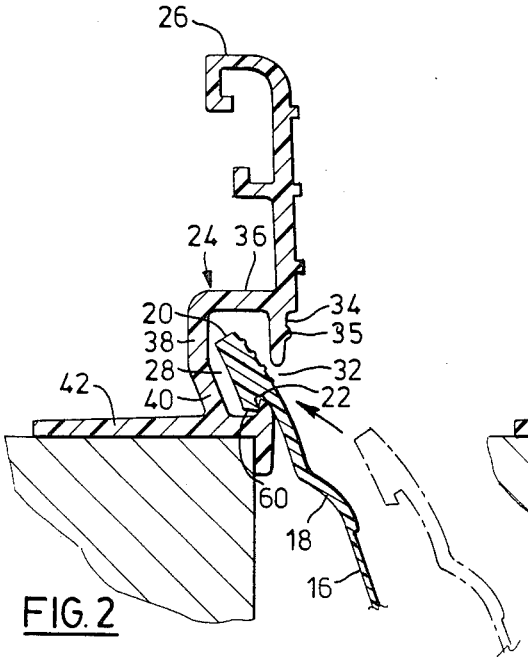
FIG. 2 is a cross-sectional elevation of the retaining element shown in FIG. 1, which view illustrates the method for inserting the liner bead.

In FIG. 2, the liner bead 20 is shown inserted into the holding channel 28. When the clip 44 is not in place, the bead 20 can easily be removed through the slot 32 by lifting the liner sufficiently that the bottom edge 60 of the bead will clear the top of the upwardly extending flange 30.

Figure 3:
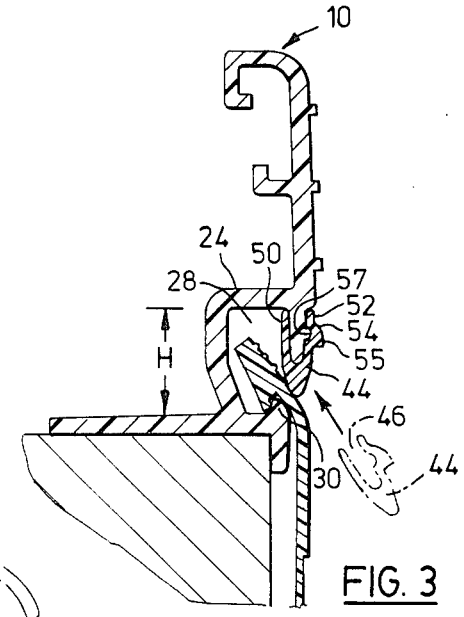
FIG. 3 is a cross-sectional elevation similar to FIG. 2 but illustrating a clip attached to the retaining element in order to hold the liner bead in the holding channel.

It will be appreciated from FIG. 3 that the liner bead 20 can be secured in the retaining element simply by pushing the clip 44 upwardly onto the flange 34. The clip 44 will be pressed into tighter engagement with the sides of flange 34 when the liner bead 20 is fixed in the holding channel and the liner attached to the bead is pulled downwardly by forces acting thereon. Thus when the swimming pool is filled with water to exert pulling forces on the liner, the liner bead 20 will move to the position shown in FIG. 3 and the flange 30 together with the clip 44 will prevent the liner bead from being pulled out. At the same time, the clip 44 is held in position on the flange by the liner bead 20 and the adjacent section of the liner.

Having described a preferred embodiment of the invention, it will be appreciated by those skilled in this art that various modifications may be made to the described structure. For example, the clip 44 could have a shape other than a V-shape. It might for example have a round or rectangular cross-section. Although it is preferred that the upwardly extending flange 30 be located in a vertical plane located slightly inwardly from the bottom edge of the clip 44, the flange 30 could be located in the same vertical plane as the bottom edge 48 of the clip.

Although in the preferred embodiment, polyvinyl chloride is used as the basic material, the retaining element and the clip could be extruded from aluminum. Also, any other suitable plastics material could be used for the retaining element and the clip. An example of another type of plastics material is a product referred to as DELRIN, which is a trademark of E.I. Dupont de Nemours & Co. of Wilmington, Delaware. DELRIN is an acetyl-resin type plastic with high fatigue resistance and a generally uniform spring constant characteristic.

It will also be appreciated that the liner bead 20 can be removed from the retainer simply by pushing the bead 20 further into the retainer and then pushing or pulling the clip 44 downwards so as to remove it from the flange 34.

We therefore claim:

1. A pool liner retainer comprising;

an elongated retaining element including means defining a longitudinal holding channel for accommodating a pool liner bead, said holding channel having an upper wall, a rear wall, a bottom wall having an upwardly extending first flange, and a front wall defined by a downwardly extending second flange, said second flange extending from said top wall toward said bottom wall, the area between the bottom of said second flange and the top of said first flange forming a slot for insertion of the linear bead into said holding channel; and an elongated resilient clip means for insertion over said second flange from the bottom of said second flange and for entrapping the linear bead within said holding channel, said clip means including means defining a longitudinal cavity therein for receiving said second flange when said clip means is inserted over said second flange and for retaining said clip means on said second flange by tight fitting engagement with said second flange, whereby when said clip means is assembled on said second flange, forces acting on said pool liner will cause said liner bead to hook on said first flange and press said clip means into tighter engagement with said second flange thereby to prevent separation of said liner bead from said holding channel.

2. A pool liner retainer according to claim 1, wherein said clip means is of generally V-shaped cross section, with said cavity being open to widened top of said clip means.

3. A pool liner retainer according to claim 1, wherein said holding channel has a height slightly greater than the combined heights of the liner bead and said upwardly extending flange.

4. A pool liner retainer according to claim 1, wherein the height of said clip means is at least three-quarters the height of said holding channel and wherein said downwardly extending second flange projects approximately one-half the height of said holding channel from said top wall of said holding channel.

5. A pool liner retainer according to claim 1, wherein said upwardly extending first flange is disposed slightly closer to said rear wall of said holding channel than said downwardly extending second flange.

6. A pool liner retainer according to claim 1, wherein said clip means comprises a clip having inner and outer legs defining respective longitudinal sides of said cavity, where in said inner leg is substantially straight, and wherein said outer leg has a longitudinally extending ridge formed on the outside thereof.

7. A pool liner retainer according to claim 1, wherein said clip means is formed of resilient plastic.

8. A pool liner retainer according to claim 1, wherein said clip means is formed of polyvinyl chloride.

9. A pool liner retainer according to claim 1, wherein said downwardly extending second flange has a longitudinally extending ridge formed on the outside thereof and wherein said clip means has inner and outer legs defining respective longitudinal sides of said cavity, said outer leg having a longitudinally extending recess on the inside thereof which recess is positioned to receive said ridge when said clip means is inserted over said downwardly extending second flange.

10. A pool liner retainer according to claim 9, wherein said outer leg of said clip means has longitudinally extending ridge means formed on the outside thereof for permitting said clip means to be gripped by an installer's fingers.

11. A swimming pool liner and retainer assembly comprising, in combination:

an elongated retaining element including means defining a longitudinal holding channel, said holding channel having an upper wall, a rear wall, a bottom wall having an upwardly extending first flange, and a front wall defined by a downwardly extending second flange, said second flange extending from said top wall toward said bottom wall, the area between the bottom of said second flange and the top of said first flange forming a slot communicating with the interior of said holding channel;

a pool liner including a waterproof sheet having a retainer bead secured thereto, said retainer bead being received in said holding channel through said slot and being disposed in said channel rearward of said downwardly extending second flange; and an elongated resilient clip means inserted over said downwardly extending second flange from the bottom of said second flange, with said second flange being tightly received in a longitudinal cavity of said clip means, said clip means extending downward from said second flange such that there is a clearance between a bottom portion of said clip means and said bottom wall of said holding channel sufficient to accommodate said sheet of said pool liner but insufficient to accommodate said retainer bead of said pool liner, said retainer bead being hooked on said first flange such that forces acting on said pool liner will cause said retainer bead to press said clip means into tighter engagement with said second flange thereby to prevent separation of said retainer bead from said holding channel.

12. An assembly according to claim 11, wherein said upwardly extending first flange is disposed slightly rearward of said downwardly extending second flange relative to said holding channel.

13. An assembly according to claim 11, wherein said downwardly extending second flange has a rib received within a complementary recess in a wall of said cavity of said clip means.

14. An assembly according to claim 11, wherein said clip means is of generally V-shaped cross section, with said cavity being open to a widened top of said clip means.

* * * * *